United States Patent [19]

Iio et al.

[11] Patent Number: 5,046,935

[45] Date of Patent: Sep. 10, 1991

[54] COMPRESSOR WITH REDUCED VIBRATIONS

[75] Inventors: Masahiro Iio; Mitsuya Ono; Katsumi Sakamoto, all of Konan, Japan

[73] Assignee: Diesel Kiki Co., Ltd., Tokyo, Japan

[21] Appl. No.: 486,000

[22] Filed: Feb. 27, 1990

[30] Foreign Application Priority Data

Mar. 29, 1989 [JP] Japan ..... 1-77300

[51] Int. Cl.[5] ..... F04C 29/00

[52] U.S. Cl. ..... 417/312; 417/902; 418/181; 181/238; 181/239

[58] Field of Search ..... 418/259, 180, 181; 417/312, 542, 902; 181/198, 224, 229, 230, 237, 239, 264, 268

[56] References Cited

U.S. PATENT DOCUMENTS

| | | | |
|---|---|---|---|
| 674,210 | 5/1901 | Loomis | 181/239 |
| 2,019,697 | 11/1935 | Smith | 181/239 |
| 2,936,041 | 5/1960 | Sharp et al. | 417/312 |
| 4,815,945 | 3/1989 | Nakajima et al. | 417/295 |
| 4,863,356 | 9/1989 | Ikeda et al. | 181/238 |
| 4,924,966 | 5/1990 | Kanda et al. | 181/268 |
| 4,929,157 | 5/1990 | Steele et al. | 417/312 |

FOREIGN PATENT DOCUMENTS

| | | | |
|---|---|---|---|
| 159493 | 6/1989 | Japan | 418/181 |
| 706551 | 12/1979 | U.S.S.R. | 181/239 |

*Primary Examiner*—Richard A. Bertsch
*Assistant Examiner*—David L. Cavanaugh
*Attorney, Agent, or Firm*—Frishauf, Holtz, Goodman & Woodward

[57] ABSTRACT

A compressor includes at least one compression space for compressing refrigerant, at least one communication chamber into which the refrigerant is discharged from the compression space, a discharge pressure chamber, and at least one communications passage communicating the communication chamber with the discharge pressure chamber for feeding the refrigerant from the communication chamber into the discharge pressure chamber. The length of the passage is longer than the diameter of the passage.

7 Claims, 6 Drawing Sheets

COMPRESSOR WITH REDUCED VIBRATIONS

BACKGROUND OF THE INVENTION

This invention relates to a compressor for compressing refrigerant circulating through an air-conditioning unit for automotive vehicles.

Conventionally, a compressor of this kind has been disclosed, e.g. by U.S. Pat. No. 4,815,945. As shown in FIG. 1, this compressor comprises a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2.

A pair of compression spaces 12 are defined by the front and rear side blocks 3, 4, and the rotor 2, and a discharge pressure chamber 10 is defined by the front side block 3 and the front head 5. Refrigerant outlet ports 16 are formed through lateral side walls of the cam ring, and a communication chamber 20 is defined by each lateral side wall of the cam ring 1 and a corresponding discharge valve cover 17. A communication passage 30 is formed through the front side block 3 and communicates the communication chamber 20 with the discharge pressure chamber 10.

Refrigerant gas discharged from the compression space 12 flows into the discharge pressure chamber 10 via the refrigerant outlet ports 16, the communication chamber 20, and the communication passage 30.

The refrigerant gas discharged into the communication chamber 20 from the compression chamber 12 is under pulsation, and the pulsating refrigerant gas directly flows into the discharge pressure chamber 10 via the communication passage 30, causing vibrations in the longitudinal directions of the compressor. The frequency of the vibrations is approximately equal to ten times the number of revolutions per second of the rotor 2. For example, if the number of revolutions per second of the rotor is 30, the frequency of the vibrations is 300 Hz. Thus, the conventional vane compressor, when installed in an automotive vehicle, generates vibrations having a frequency of 300 to 800 Hz, so that other components of the automotive vehicle vibrate by resonance to cause offensive noise.

Therefore, the occurrence of noise due to vibrations caused by the flow of the refrigerant gas into the discharge pressure chamber can be prevented by attenuation of pulsation of the refrigerant gas.

SUMMARY OF THE INVENTION

It is the object of the invention to provide a compressor which is capable of suppressing vibrations by attenuating the pulsation of refrigerant gas discharged from the compression chamber into the discharge pressure chamber.

To attain the above object, the present invention provides a compressor including at least one compression space for compressing a refrigerant, at least one communication chamber into which the refrigerant is discharged from the compression space, a discharge pressure chamber, and at least one communication passage communicating the communication chamber with the discharge pressure chamber for feeding the refrigerant from the communication chamber into the discharge pressure chamber.

The compressor according to the present invention is characterized in that the communication passage has a length larger than the diameter of the passage.

Preferably, the ratio of the length of the communication passage to the diameter of the communication passage is not lower than 1.2 and not higher than 6.0.

More preferably, the ratio of the length of the communication passage to the diameter of the communication passage is not lower than 2.5 and not higher than 3.0.

Preferably, the communication passage is divided into a plurality of openings.

Further preferably, the communication passage has a peripheral wall, and an outlet opening is formed in the peripheral wall.

The above and other objects, features and advantages of the invention will become more apparent from the ensuing detailed description taken in conjunction with the accompanying drawings.

DETAILED DESCRIPTION

The invention will now be described in detail with reference to the drawings.

Figure 3:
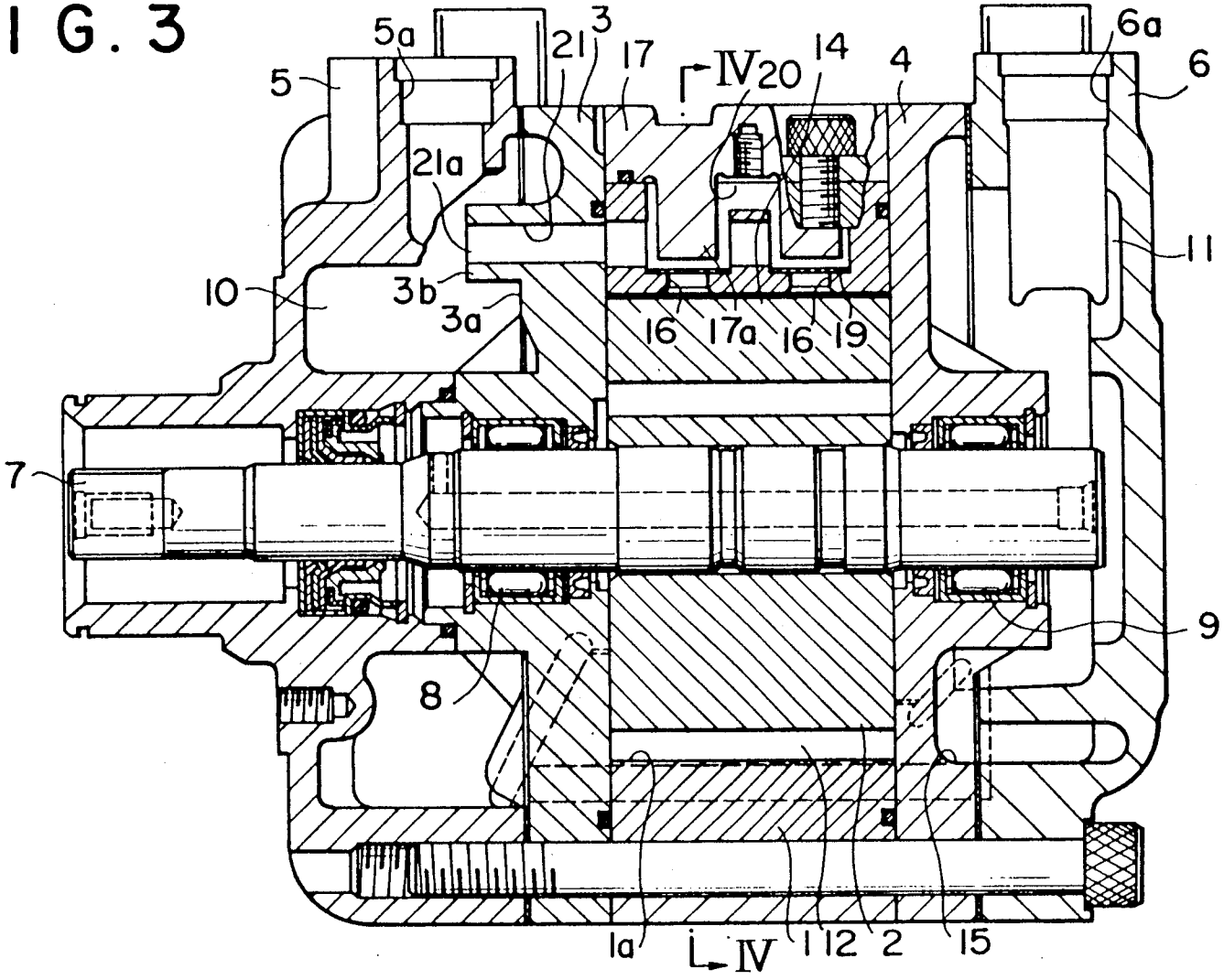
FIG. 3 is a longitudinal cross-sectional view of a vane compressor according to an embodiment of the present invention.
Figure 4:
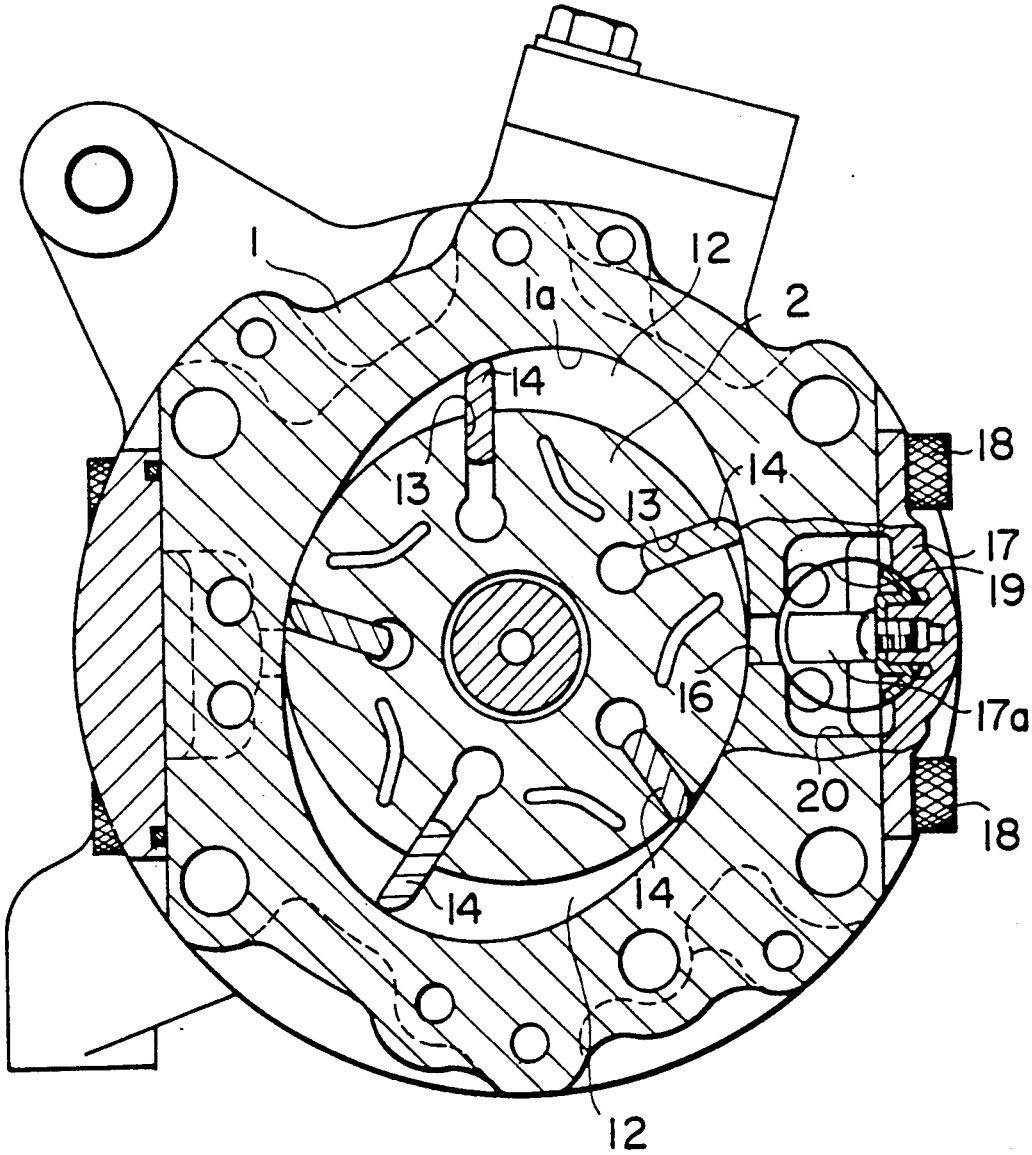
FIG. 4 is a cross-sectional view taken along line IV—IV of FIG. 3.

FIGS. 3 and 4 show a vane compressor according to an embodiment of the invention.

As shown in FIGS. 3 and 4, the vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a driving shaft 7 on which is secured the rotor 2. The driving shaft 7 is rotatably supported by a pair of radial bearings 8 and 9 provided in the respective side blocks 3 and 4.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5a and the suction port 6a communicate, respectively, with a discharge pressure chamber 10 defined by the front head 5 and the front side block 3, and a suction chamber 11 defined by the rear head 6 and the rear side block 4.

A pair of compression spaces 12, 12 are defined at diametrically opposite locations between the inner peripheral surface 1a of the cam ring 1, the outer peripheral surface of the rotor 2, and end faces of the respective front and rear side blocks 3 and 4 on the cam ring 1 side. The rotor 2 has its outer peripheral surface formed therein with a plurality of axial vane slits 13 at circumferentially equal intervals, in each of which a vane is radially slidably fitted.

Refrigerant inlet ports 15, 15 are formed in the rear side block 4 at diametrically opposite locations, as shown in FIG. 3 (since FIG. 3 shows a cross-section taken at an angle of 90° formed about the longitudinal axis of the compressor, only one refrigerant inlet port is shown in the FIG.) These refrigerant inlet ports 15 axially extend through the rear side block 4, and through which the suction chamber 11 and the compression spaces 12 are communicated with each other.

Two paris of refrigerant outlet ports 16, 16 are formed through respective opposite lateral side walls of the cam ring 1 at diametrically opposite locations. (In FIG. 4, for the same reason as in the case of the refrigerant inlet ports, only one pair of refrigerant outlet ports is shown.) To each of the opposite lateral side walls of the cam ring 1 is secured by a volt 18 a discharge valve cover 17 having a valve stopper 17a. Interposed between the lateral side wall and the valve stopper 17a is a discharge valve 19 retained by the discharge valve cover 17. Each discharge valve 19 opens in response to discharge pressure to thereby open the corresponding refrigerant outlet port 16. Defined by the cam ring 1 and the respective discharge valve covers 17 are a pair of communication chambers 20 which each communicate with a corresponding pair of the refrigerant outlet ports 16 when the corresponding discharge valve 19 opens.

Further, a projection 3b is integrally formed on the end face 3a on the front head 5 side of the front side block 3, and a pair of communication passages 21, each formed of a single opening 21a, are axially formed through the projection 3b and the front side block 3 at diametrically opposite locations. These communication passages 21 communicate with the communication chambers 20, respectively.

Next, the operation of the present embodiment constructed as above will be described below.

As the rotor 1 rotates, the volume defined by two adjacent vanes is reduced to compress refrigerant gas in the compression space 12. When the pressure of the refrigerant gas in the compression space 12 reaches a predetermined value, the refrigerant outlet ports 16 open to discharge the refrigerant gas into the communication chamber 20. The refrigerant gas discharged into the communication chamber 20 is under pulsation, and the pulsating refrigerant gas causes vibrations in the communication chamber 20 in the longitudinal directions of the compressor. The pulsating refrigerant gas flows into the discharge pressure chamber via the communication passage 21. When the refrigerant gas flows through the communication passage 21, the vibration frequency is lowered and the pressure of a pulsation having a particular frequency of the refrigerant gas is damped. As a result, when the refrigerant gas flows into the discharge pressure chamber 10, a vibration may be prevented which may induce resonance of component parts of the automotive vehicle in which the compressor is installed. Thus, the noise in the compartment of the vehicle can be greatly reduced.

The ground for the above result of the invention will be explained below:

The communication passage 21 can be regarded as an air column.

In general, the frequency $fs^{-1}$ of an air column within a conduit (i.e. the communication passage 21) having a uniform cross-section over its length can be obtained by the following equation:

$$f=(\lambda/2\pi l)\sqrt{Kg/\gamma}$$

where l is the length of the conduit, K the bulk modulus of elasticity ($Kg/cm^3$), $\gamma$ the weight of fluid per unit volume ($kg/cm^3$), g the acceleration of gravity ($g=981$ $cm/sec^2$), and $\lambda$ a dimensionless number determined by the boundary condition and the vibration waveform, the value of which is, in the case where one end of the conduit is fixed and the other end if free as in the FIG. 3 embodiment, as follows: $\lambda=\frac{1}{2}\pi$, $3/2\ \pi$, $5/2\ \pi$, . . . .

Therefore, the columnar frequency f is inversely proportional to the length l of the conduit (communication passage 21).

Figure 5A:
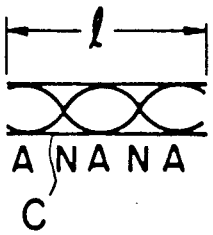
FIGS. 5*a* to 5*c* are diagrams showing waveforms of vibrations in the compressor with the length of a communication passage 21 set to respective different values.
Figure 5B:
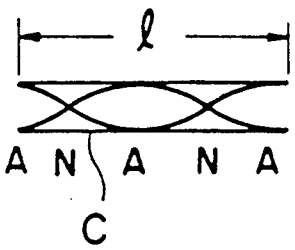
Figure 5C:
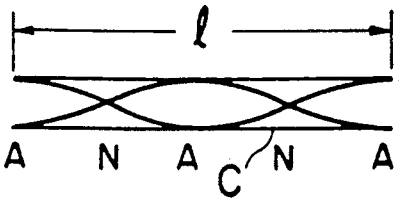

FIGS. 5a to 5c show curves representing waveforms of vibrations with the length l of a conduit C set to respective different values. As can be understood from the figures, the change rate of pressure is the maximum at nodes N of displacement or speed, and the minimum at antinodes A of same. Further, if the length l of the conduit is increased (FIG. 5c), the frequency f is decreased in accordance with the above equation, i.e. the pitch of the vibration waveform becomes longer as compared with the case of FIG. 5a in which the length l is shorter. Accordingly, the slope of the curve representing the vibration waveform becomes gentler to reduce the maximum change rate of pressure at anodes N, whereby the pulsation is damped. Further, if a node N of the vibration waveform is located at the outlet end of the conduit, a great vibration corresponding to the maximum change rate of pressure is outputted from the conduit. Therefore, the resonance of component parts of the vehicle can be avoided by setting the length l to such a value that no mode N is located at the outlet end of the communication passage 21 (FIG. 5b or 5cl).

Figure 1:
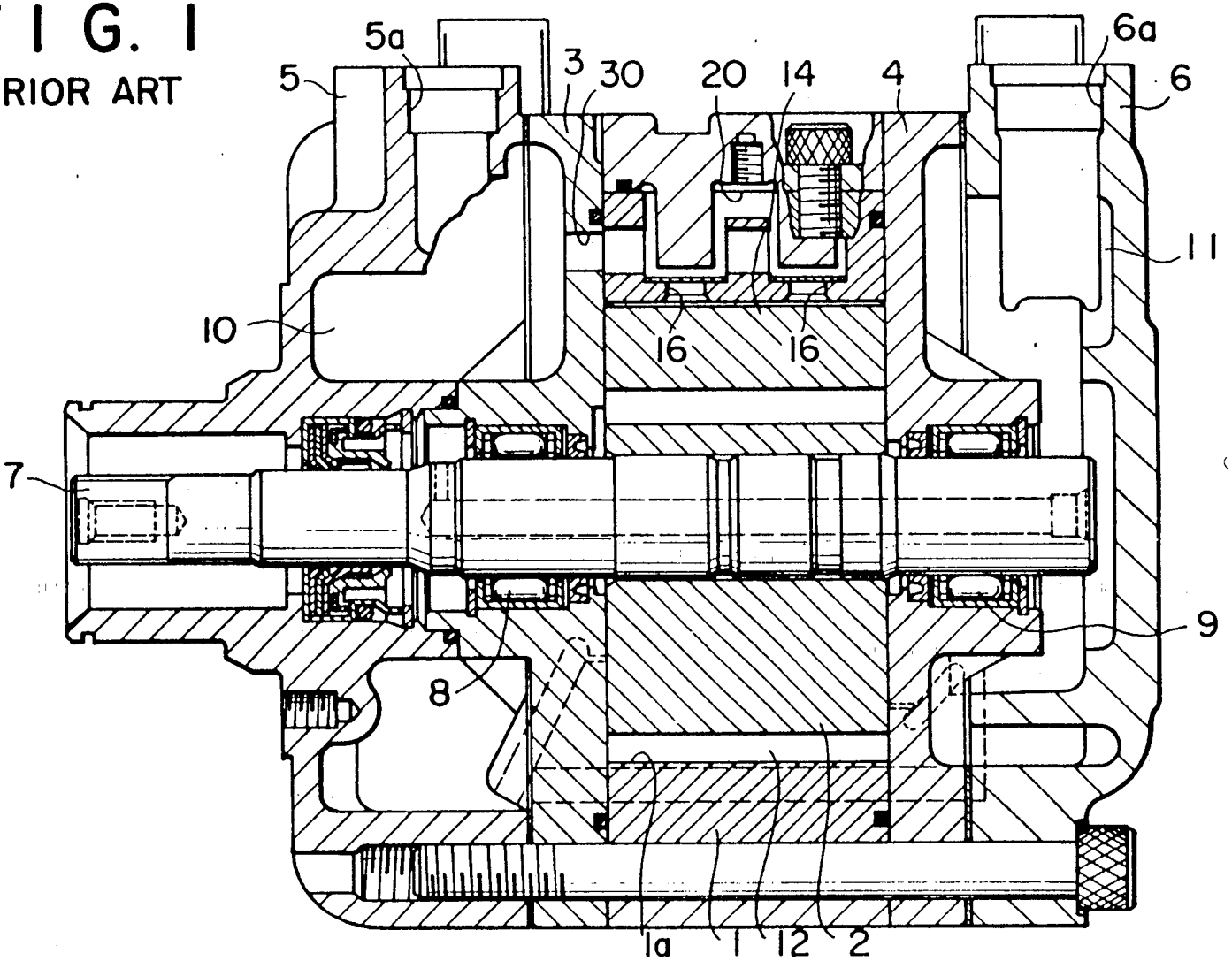
FIG. 1 PRIOR ART
FIG. 1 is a longitudinal cross-sectional view of a conventional vane compressor.
Figure 2:
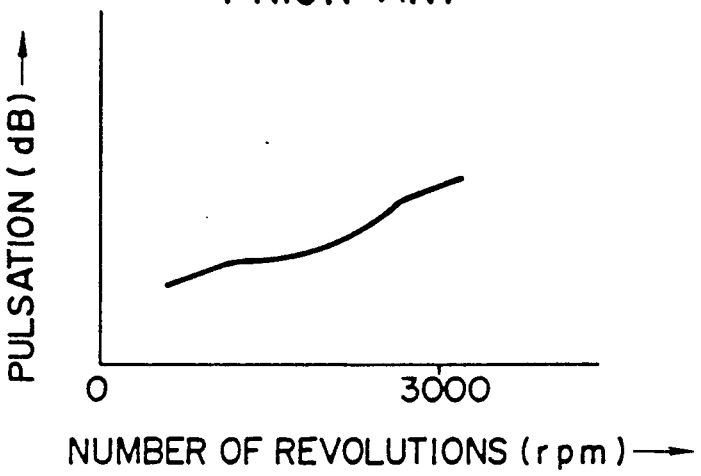
FIG. 2 PRIOR ART
FIG. 2 is a diagram showing a curve useful in explaining the vibration characteristic of the conventional vane compressor.
Figure 6:
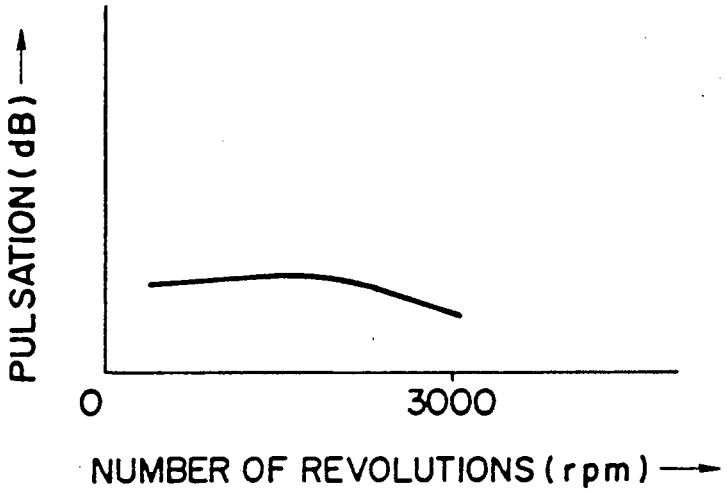
FIG. 6 is a diagram showing a curve useful in explaining the vibration characteristic of the vane compressor according to the present invention.

Experiments have revealed that when it is set that $=14$ mm, the plate thickness t of the side block $3=12$ mm, and the diameter of the conduit (the diameter of the communication passage 21)$=10$ mm, a pulsation having a certain frequency can be greatly reduced, as shown in FIG. 6. Particularly, in a medium speed region, the reduction of the pulsation is remarkably large, as distinct from a curve in FIG. 2, which is obtained by the conventional compressor.

Further, the vibrations having a frequency range of 300 to 800 Hz which is produced when the conventional compressor is installed int eh automotive vehicle can be attenuated by setting of $6 \geqq l/D \geqq 1.2l$. The valve l/D should be set to this range for the reason that if the value l/D is smaller than 1.2, the pulsation attenuating effect cannot be attained to a sufficient degree, while if it is larger than 6, the arrangement becomes impractical because the value D cannot be too small since the communication passage, if it has too small a diameter, will have a restricting effect. Preferably, the range is $3.0 \geqq l/D \geqq 2.5$.

Figure 8A:
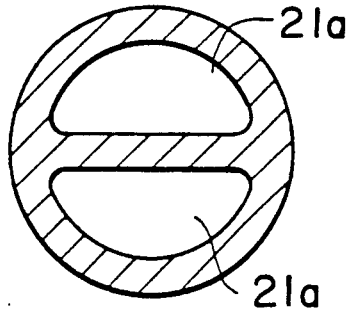
FIGS. 8*a* to 8*c* are enlarged transverse cross-sectional views of passages of vane compressors according to other variations of the present invention.
Figure 8B:
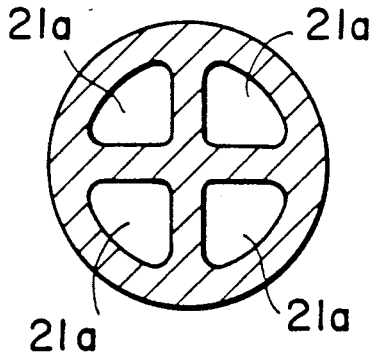
Figure 8C:
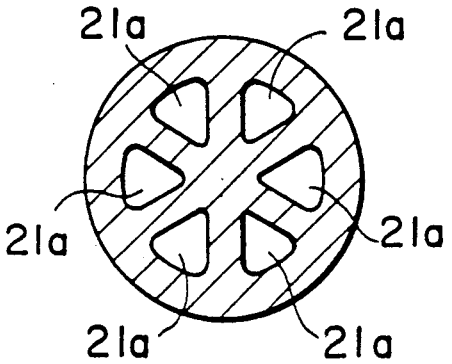

In the above described embodiment, the communication passage 21 has a single opening 21*a*. However, the communication passage 21 may be divided into e.g. 2 to 4 openings 21*a* as shown in FIGS. 8*a* to 8*c*. These arrangements can attenuate vibrations without increasing the length of the passage 21, i.e. the thickness of the side block 3.

This effect is supported by the following fact:

Normally, the fluid discussed in the field of engineering is in the form of a turbulent flow. However, the closer to a laminar flow the form of a fluid, the pulsation of the fluid can be more suppressed. If the distance between an inlet end of a conduit and a point in the conduit at which the fluid starts to form a laminar flow is X, and the diameter of the conduit is D, the following equation can be established according to Boussinesq:

$$X/D \geqq 0.065\ Re$$

where Re represents the Reynolds number of the fluid.

In other words, the suppressibility of the pulsation of the fluid depends on the ratio of X to D which is required from the above equation.

The Reynolds number is determined as follows:

$$Re = Dup/\mu$$

where $\mu$ is the average speed of the fluid over the whole cross-sectional area of the conduit, $\rho$ the density of the fluid, and $\mu$ the viscosity coefficient of the fluid.

Therefore, by axially dividing the interior of the conduit (or the communication passage 21) into two or more openings 21*a* having reduced diameters D, the Re number can be decreased, which enables the distance X to be shortened.

Thus, the pulsation of the refrigerant gas can be attenuated by dividing the passage 21 into two or more openings 21*a*.

Figure 7:
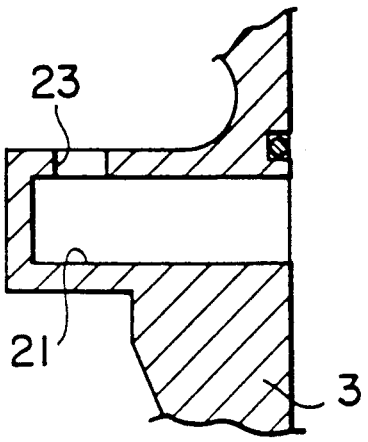
FIG. 7 is an enlarged longitudinal cross-sectional view of part of a vane compressor according to a variation of the present invention.

Further, in the embodiment of FIG. 3, the both open ends of the passage 21 are opposed to each other. Alternatively, as shown in FIG. 7, a through hole 23 as an outlet opening may be formed in the peripheral wall of the passage 21 and one end thereof closer to the through hole 23 may be closed to allow the refrigerant gas to be discharged in a vertical direction relative to the axis of the driving shaft 7, whereby the same results as obtained by the FIG. 3 embodiment can be obtained.

Although in the above described embodiments, the invention is applied to a vane compressor, this is not limitative, but the invention may be applied to other types of compressors, such as a wobble-plate type compressor and a swash-plate type compressor.

What is claimed is:

1. In a vane compressor including a cam ring, a rotor rotatably received in said cam ring, said rotor having at least one vane slit formed therein, at least one vane each slidably fitted in an associated one of said at least one vane slit, front and rear side blocks closing respective end openings of said cam ring, said front side block having an end face remote from said cam ring, said rotor and said front and rear side blocks defining therebetween at least one compression space for compressing a refrigerant, at least one communication chamber into which said refrigerant is discharged from said compression space, a discharge pressure chamber, and at least one communication passage communicating said communication chamber with said discharge pressure chamber for feeding said refrigerant from said communication chamber into said discharge pressure chamber, the improvement wherein:

a projection is formed integrally on said end face on said front side block;

said communication passage is formed in said front side block and extends through said projection; and said communication passage having a diameter and a length, the length of said communication passage being larger than the diameter of said communication passage.

2. A compressor according to claim 1, wherein the ratio of the length of said communication passage to the diameter of said communication passage is not lower than 1.2 and not higher than 6.0.

3. A compressor according to claim 1, wherein the ratio of the length of said communication passage to the diameter of said communication passage is not lower than 2.5 and not higher than 3.0.

4. The compressor according to claim 1, wherein said communication passage is divided into a plurality of openings.

5. A compressor according to claim 1, wherein said communication passage has a peripheral wall, and an outlet opening is formed in said peripheral wall.

6. A compressor according to claim 2, wherein said communication passage is divided into a plurality of openings.

7. A compressor according to claim 2, wherein said communication passage has a peripheral wall, and an outlet opening is formed in said peripheral wall.

* * * * *